US008651342B1

(12) United States Patent
Sexton

(10) Patent No.: US 8,651,342 B1
(45) Date of Patent: Feb. 18, 2014

(54) APPARATUS AND METHOD FOR FORMING AND MAINTAINING A SHAPE

(71) Applicant: Perfect Glove LLC, Cedar Park, TX (US)

(72) Inventor: Robert Sexton, Cedar Park, TX (US)

(73) Assignee: Perfect Glove LLC, Cedar Park, TX (US)

( * ) Notice: Subject to any disclaimer, the term of this patent is extended or adjusted under 35 U.S.C. 154(b) by 0 days.

(21) Appl. No.: 13/647,551

(22) Filed: Oct. 9, 2012

(51) Int. Cl.
*A41D 1/00* (2006.01)

(52) U.S. Cl.
USPC ..... 223/78

(58) Field of Classification Search
USPC ..... 223/78–80, 66, 84; 206/213, 278, 206/315.1, 315.9
See application file for complete search history.

(56) References Cited

U.S. PATENT DOCUMENTS

| | | | | | |
|---|---|---|---|---|---|
| 4,418,849 | A * | 12/1983 | Santa | 223/78 |
| 4,765,519 | A * | 8/1988 | Groves | 223/78 |
| 4,877,162 | A * | 10/1989 | McGinley | 223/78 |
| 4,883,170 | A * | 11/1989 | Wright | 206/315.1 |
| 4,958,729 | A * | 9/1990 | Wright | 206/315.1 |
| 5,000,317 | A * | 3/1991 | Cich | 206/315.1 |
| 5,267,677 | A * | 12/1993 | Nash | 223/78 |
| 5,456,390 | A * | 10/1995 | McFarland | 223/78 |
| 5,758,805 | A * | 6/1998 | Dunn | 223/78 |
| 5,810,215 | A * | 9/1998 | Plymell | 223/78 |
| 6,430,746 | B1 * | 8/2002 | Watson | 2/19 |

* cited by examiner

*Primary Examiner* — Nathan Durham
(74) *Attorney, Agent, or Firm* — James R Bell

(57) ABSTRACT

A shape is formed and maintained in a shapeable object by a flexible wrap and a shaped device. The shaped device is placed in the shapeable object and wrapped by the flexible wrap. Adjustment of the wrap secures the shaped device in the shapeable object and compresses the flexible wrap around the shapeable object and the shaped device resulting in the shapeable object conforming to the shape of the shaped device.

24 Claims, 13 Drawing Sheets

APPARATUS AND METHOD FOR FORMING AND MAINTAINING A SHAPE

CROSS-REFERENCE TO RELATED APPLICATIONS

This application is related to the U.S. Provisional Application No. 61/597,070 filed Feb. 2, 2012, which is incorporated herein by reference in its entirety.

BACKGROUND

In the past, many methods have been used for breaking-in a new ball glove, such as a baseball or softball glove. When purchased, a new glove is generally stiff and when worn, the glove pocket is difficult to open and close by movement of the user's hand, which is inserted into the glove. One of the most well known ways to break-in a new glove is to generously lubricate the glove pocket, place a baseball or softball in the pocket, and wrap the glove tightly around the ball. As a result, the ball assists in forming the desired pocket and the lubrication of the pocket helps to break down the stiffness.

Although acceptable results may be achieved by the above-described method, the results may not be suitable for all gloves. For example, a fielder's glove, a first baseman's glove and a catcher's glove differ in construction, size and function and therefore the single break-in method descried above, while acceptable for one glove, may not be as effective for a glove used at a different position.

Accordingly, it would be beneficial to provide for varying the glove conditioning so that the different gloves used at different positions may be conditioned and broken in, in a manner which enhances their usefulness and functioning. Also, it would be beneficial to provide a system and devices for maintaining and protecting the glove and maintaining the shape of the glove pocket.

SUMMARY

One embodiment accordingly, includes apparatus for forming and maintaining a shape including a flexible wrap and a shaped device of a selected or glove-specific shape for insertion into a shapeable object such as the concave surface of a glove pocket. The glove or shapeable object is wrapped in the flexible wrap. Adjustment of the wrap is provided for securing the shapeable object or glove, along with the shaped device within the flexible wrap and for compressing the flexible wrap around the flexible object or glove including the shaped device. As a result, the concave surface of the pocket is conformed to the selected shape of the shaped device.

DETAILED DESCRIPTION

A glove of the type used in baseball and softball is position specific with regard to shape and size. For example, a catcher's glove, a first baseman's glove an outfielder's glove and an infielder's glove, including a pitcher's glove, all differ in size and shape as well as pocket size and shape.

In order to break-in a specific glove, an insert or form is provided by a suitable synthetic material which has a shape and size appropriate to assist in forming a pocket size and shape desired for that glove. As such, multiple forms or inserts of a molded synthetic material are provided and are illustrated.

Figure 1:
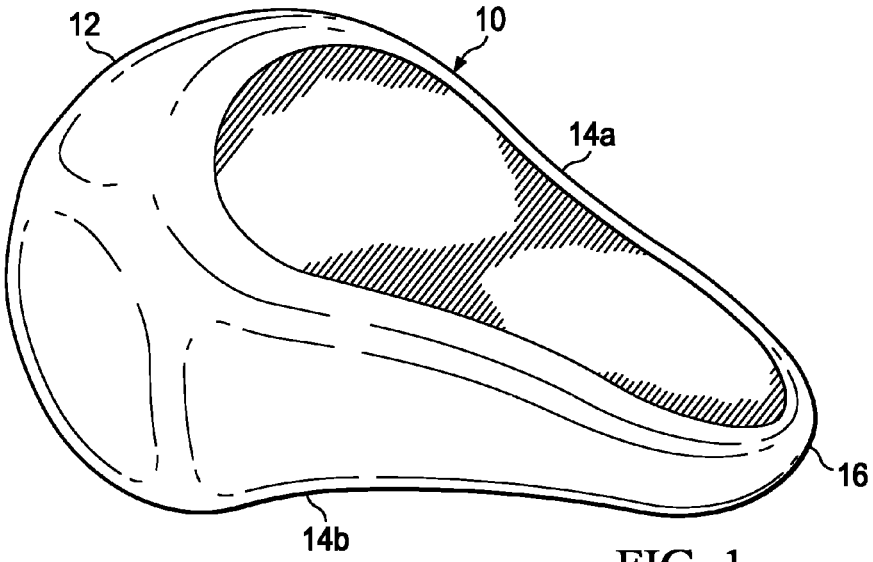
FIGS. 1-4 are perspective views illustrating embodiments of various pocket forms.

A first form 10 is illustrated in FIG. 1 and is generally of a triangular or teardrop shape. The form 10 includes a first bulbous or rounded ended 12, which is substantially wide and thick. The form 10 tapers along elongated linear sides 14*a*, 14*b* to a second end 16, opposite the first end 12, which is substantially small and pointed relative to the first end 12.

Figure 2:
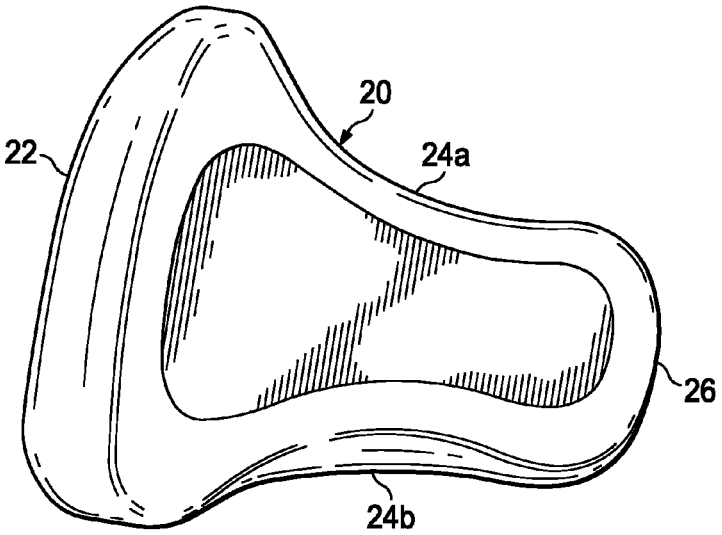

A second form 20 is illustrated in FIG. 2 and is also of a generally triangular shape. The form 20 includes a first blunt end 22, which is substantially wide and thick. The form 20 tapers along elongated curved sides 24*a*, 24*b* to a second blunt end 26, opposite the first blunt end 22, which is substantially smaller relative to the first end 22.

Figure 3:
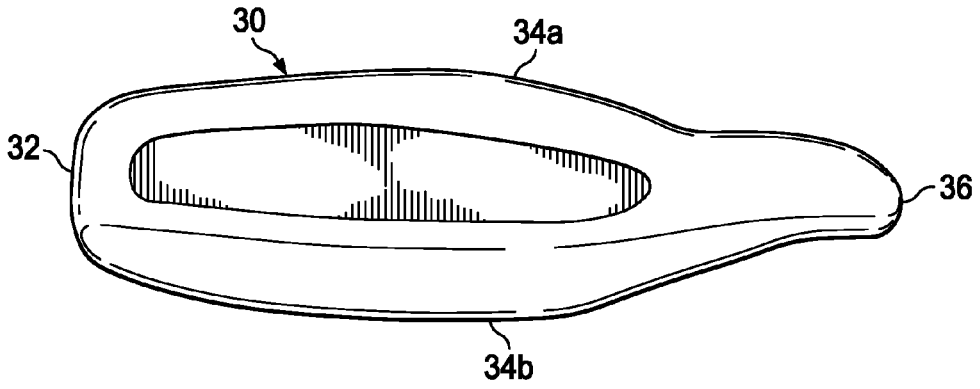

A third form 30 is illustrated in FIG. 3 and is generally of an elongated shape having a first blunt end 32, a consistent width defined by opposite sides 34*a*, 34*b*, and a narrow, extended second end 36. The second end 36 has a substantially pot-handle shape.

Figure 4:
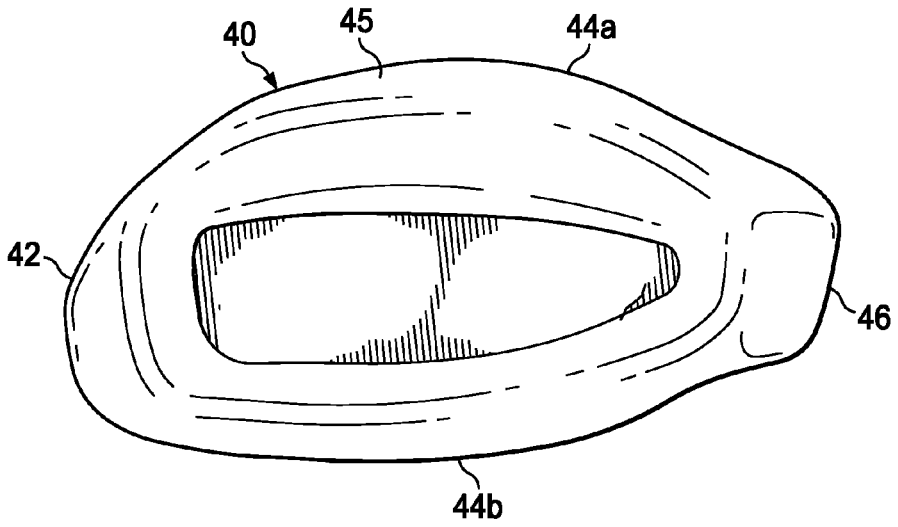

A fourth form 40 is illustrated in FIG. 4 and is generally elongated having opposite blunt ends 42, 46 separated by an enlarged mid-section 45 having curved sides 44*a*, 44*b* which midsection is substantially wider than the opposite ends 42, 46 and or substantially bulbous in appearance.

Figure 5:
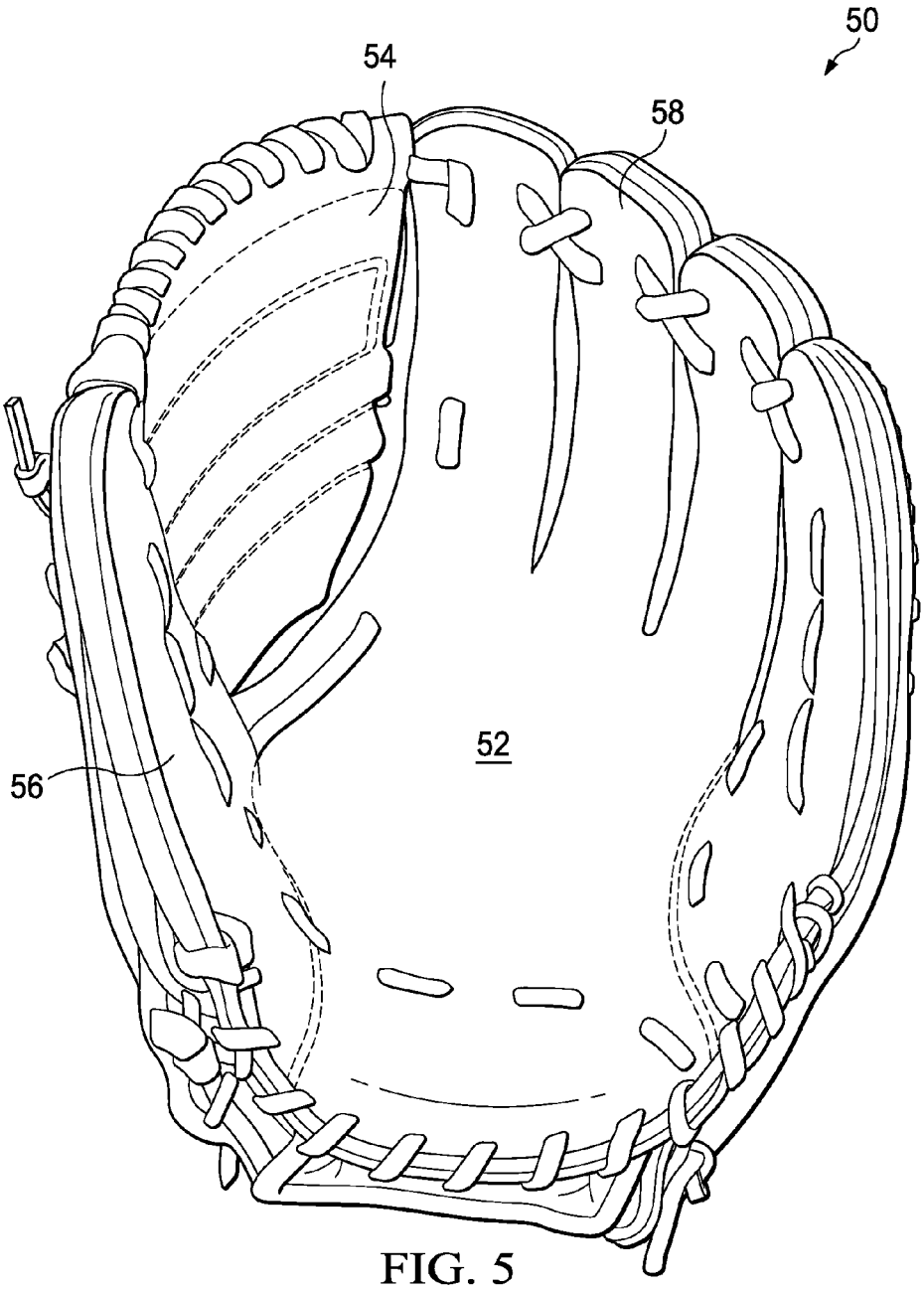
FIG. 5 is a perspective view illustrating an embodiment of a fielder's glove.

One glove type is a well known fielder's glove 50, FIG. 5. Fielder's gloves 50 can include an infielder's glove, a pitcher's glove and an outfielder's glove. Each of these gloves may vary slightly but are substantially similar; therefore, these gloves will be generally described as fielder's gloves 50 for purposes of this discussion.

Figure 6:
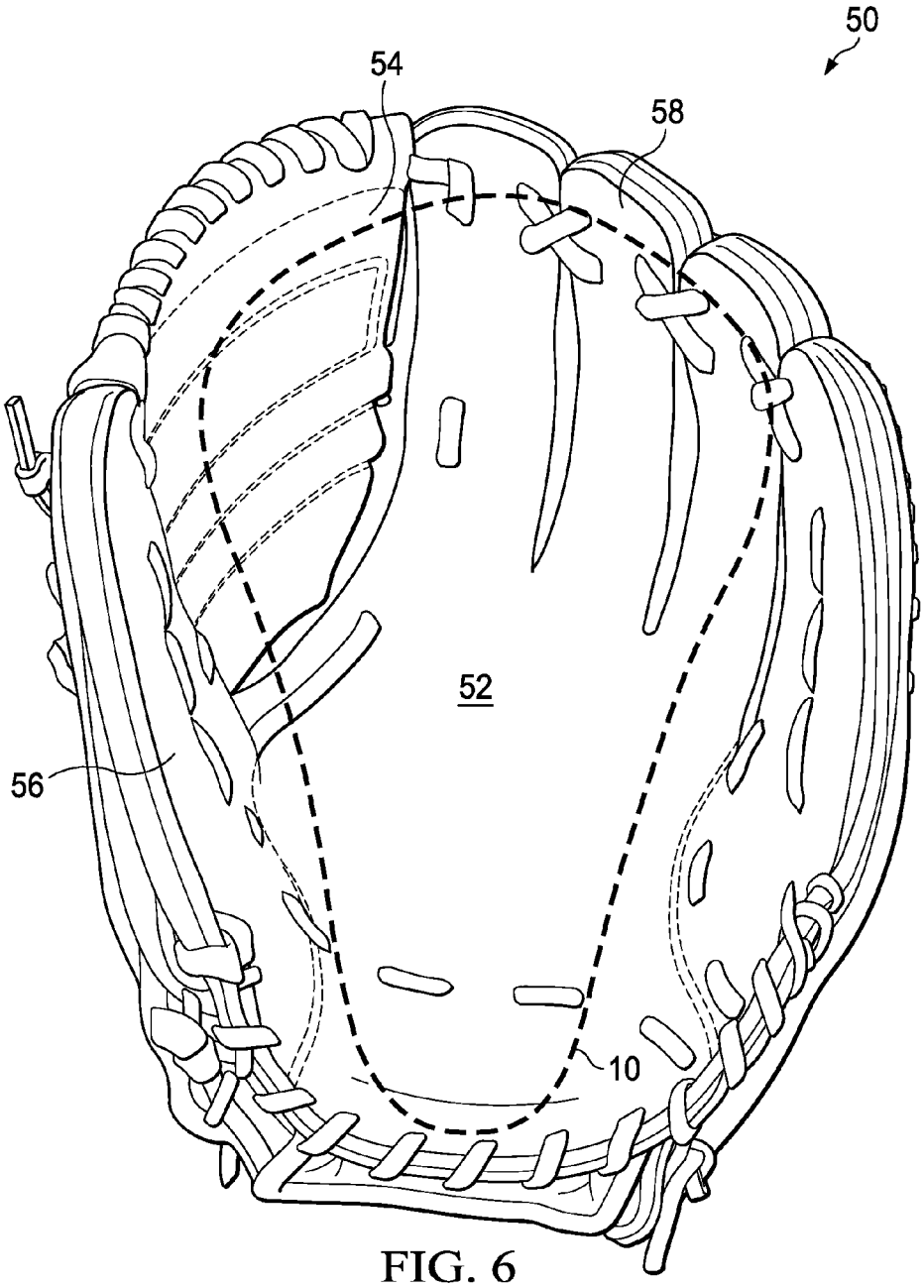
FIG. 6 is a perspective view illustrating the glove of FIG. 5 including a form inserted in the glove pocket.
Figure 7:
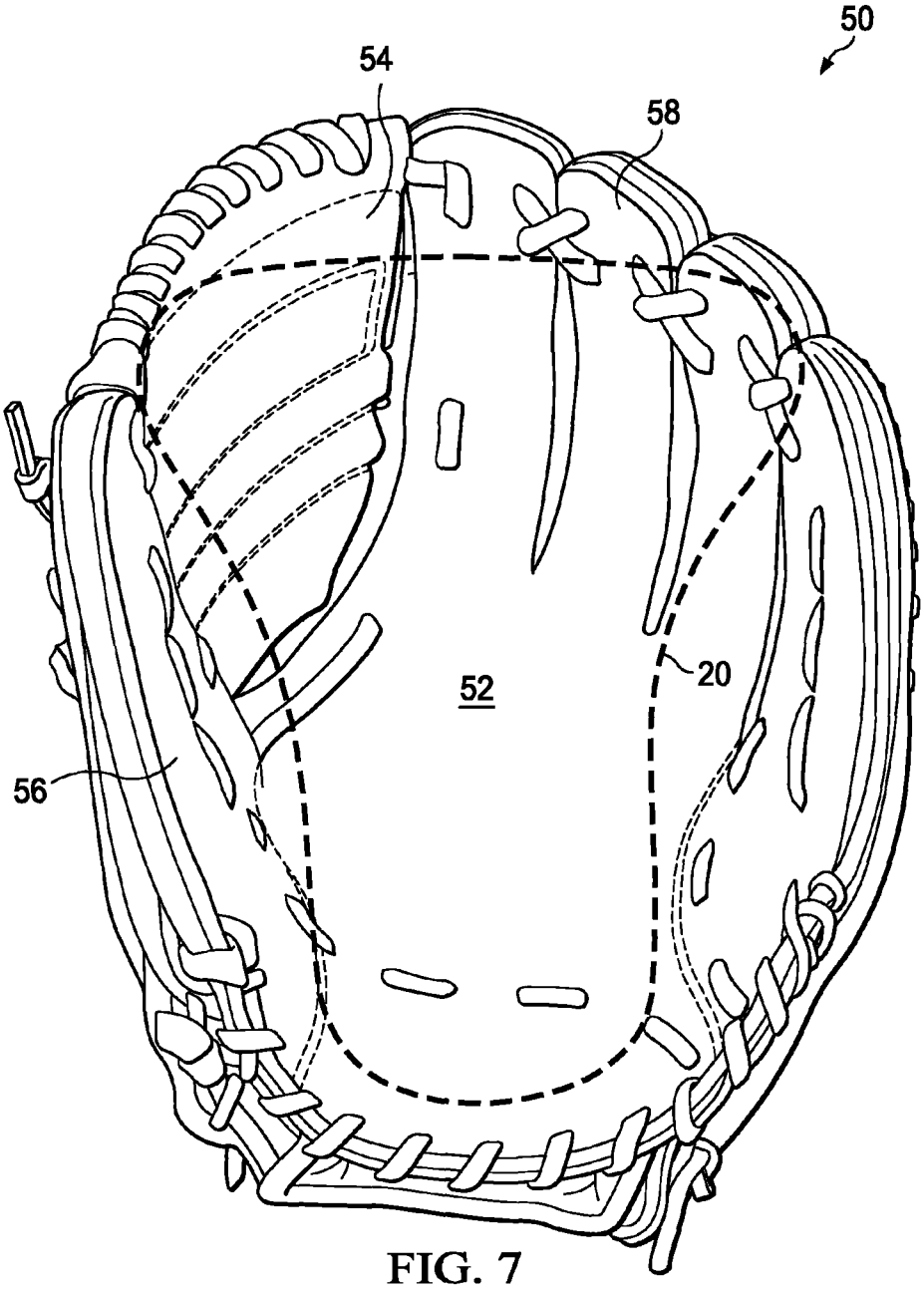
FIG. 7 is a perspective view illustrating the glove of FIG. 5 including another form inserted in the glove pocket.

For breaking-in a fielder's glove 50, FIG. 5, one of the first and second forms, i.e. forms 10 or 20 of FIGS. 1 and 2, can be selectively used to form and maintain a pocket. The fielder's glove pocket, as is well known, is a concave area 52 of the glove positioned adjacent a web portion 54 and also positioned between a thumb receiving portion 56 and a plurality of finger receiving portions 58. One of the first and second forms 10 or 20, is selected by the user of the glove and is inserted into the pocket 52, see FIGS. 6 and 7.

Figure 8:
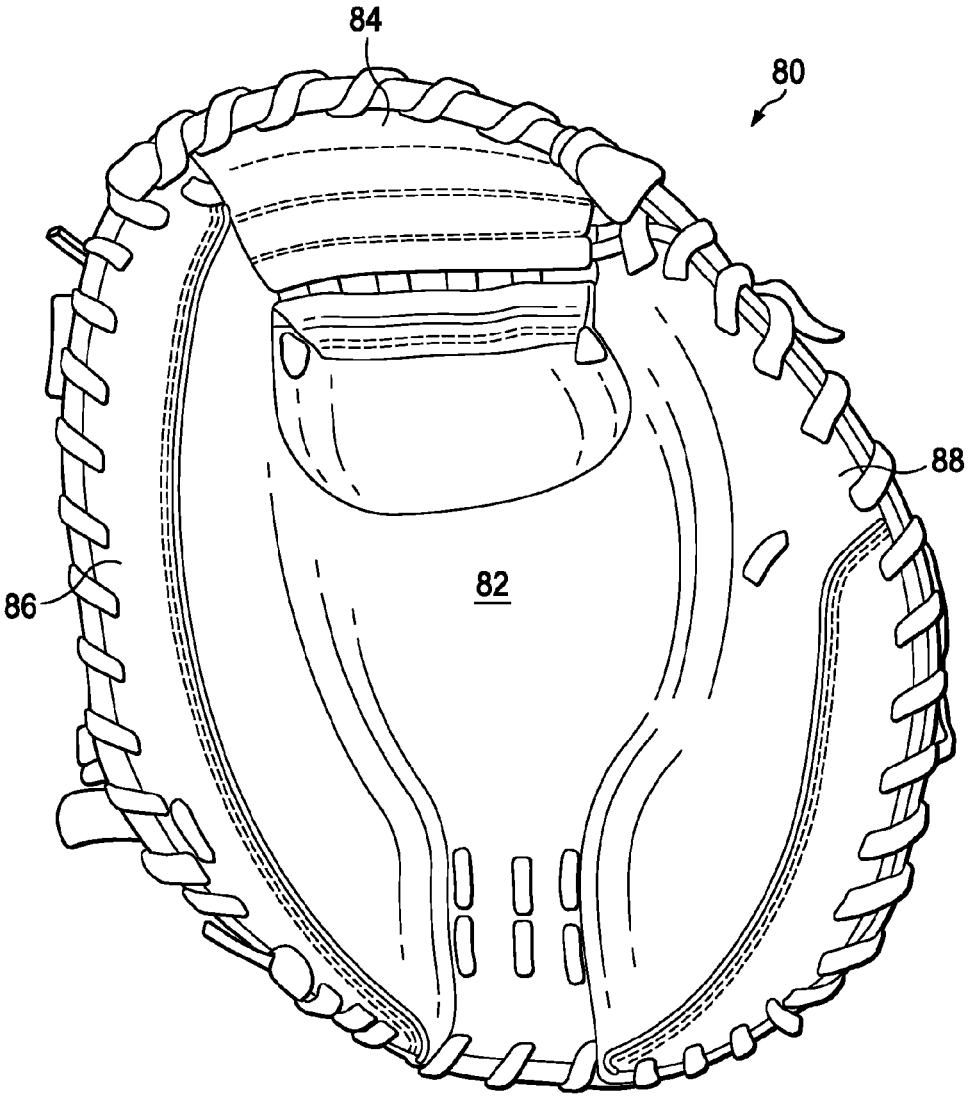
FIG. 8 is a perspective view illustrating an embodiment of a catcher's glove.
Figure 9:
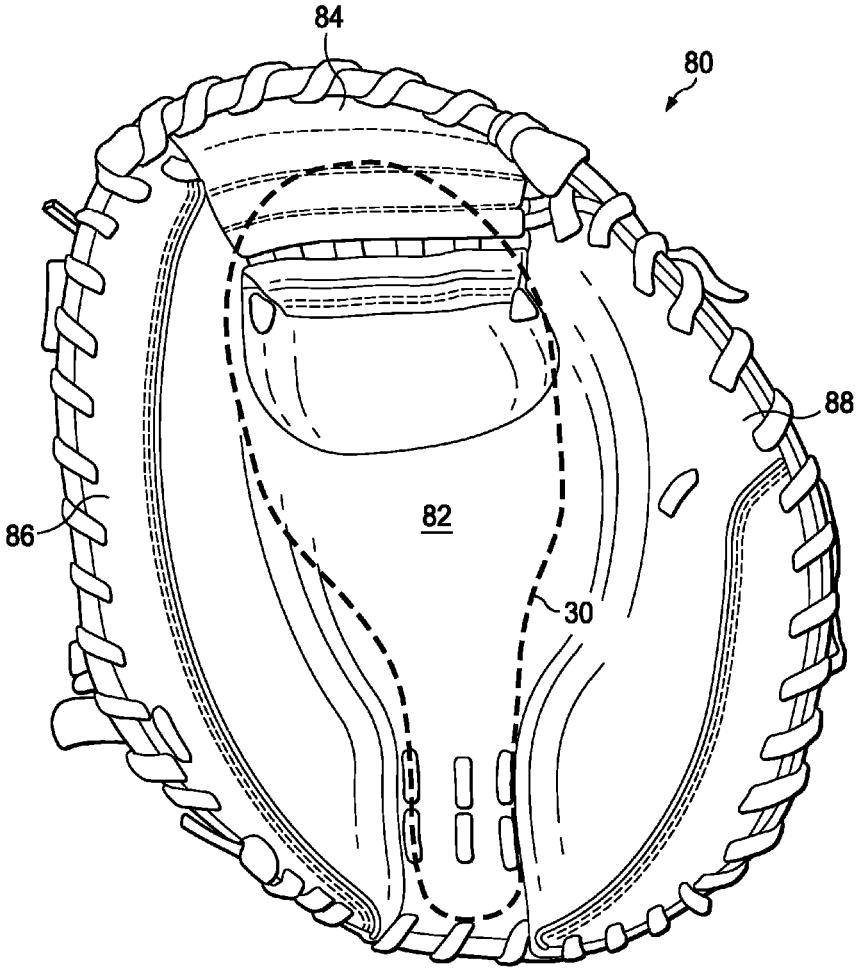
FIG. 9 is a perspective view illustrating an embodiment of the glove of FIG. 8 including a form inserted in the glove pocket.

For breaking-in a well known catcher's glove 80, FIG. 8, the third form i.e. form 30, FIG. 3, can be used to form and maintain a pocket. The catcher's glove pocket, as is well known, is the concave area 82 of the glove 80 positioned adjacent a web portion 84 and also positioned between a thumb receiving portion 86 and a multiple finger receiving portion 88. The third form 30 is inserted into the pocket 82, see FIG. 9.

Figure 10:
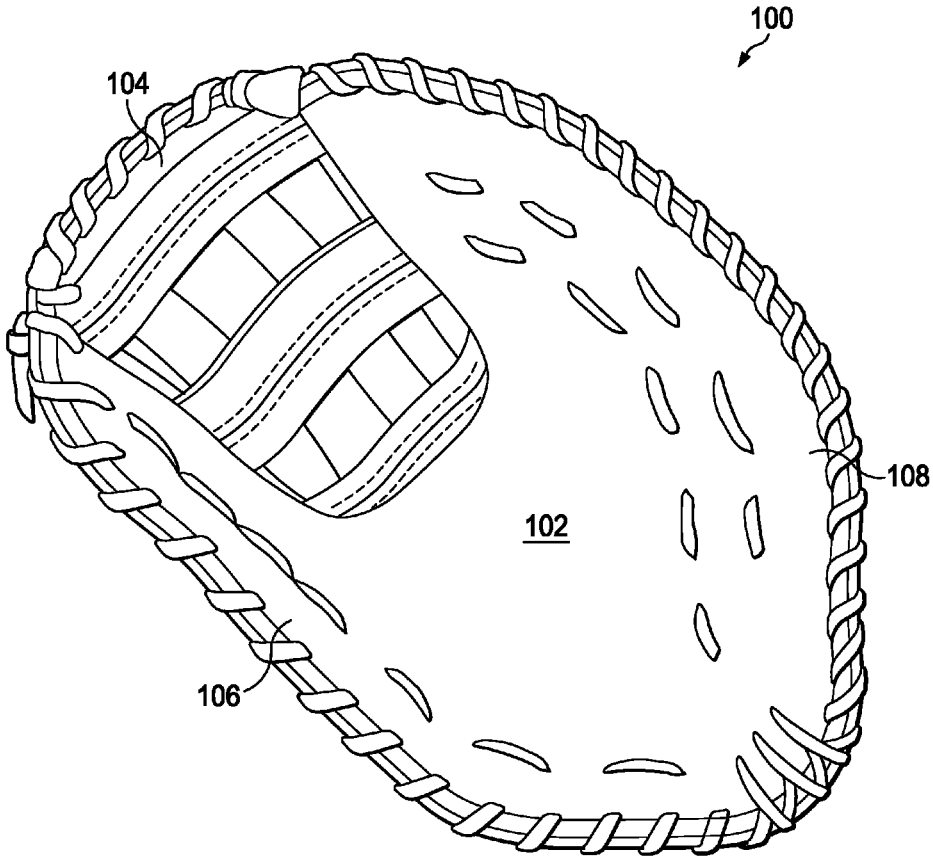
FIG. 10 is a perspective view illustrating an embodiment of a first baseman's glove.
Figure 11:
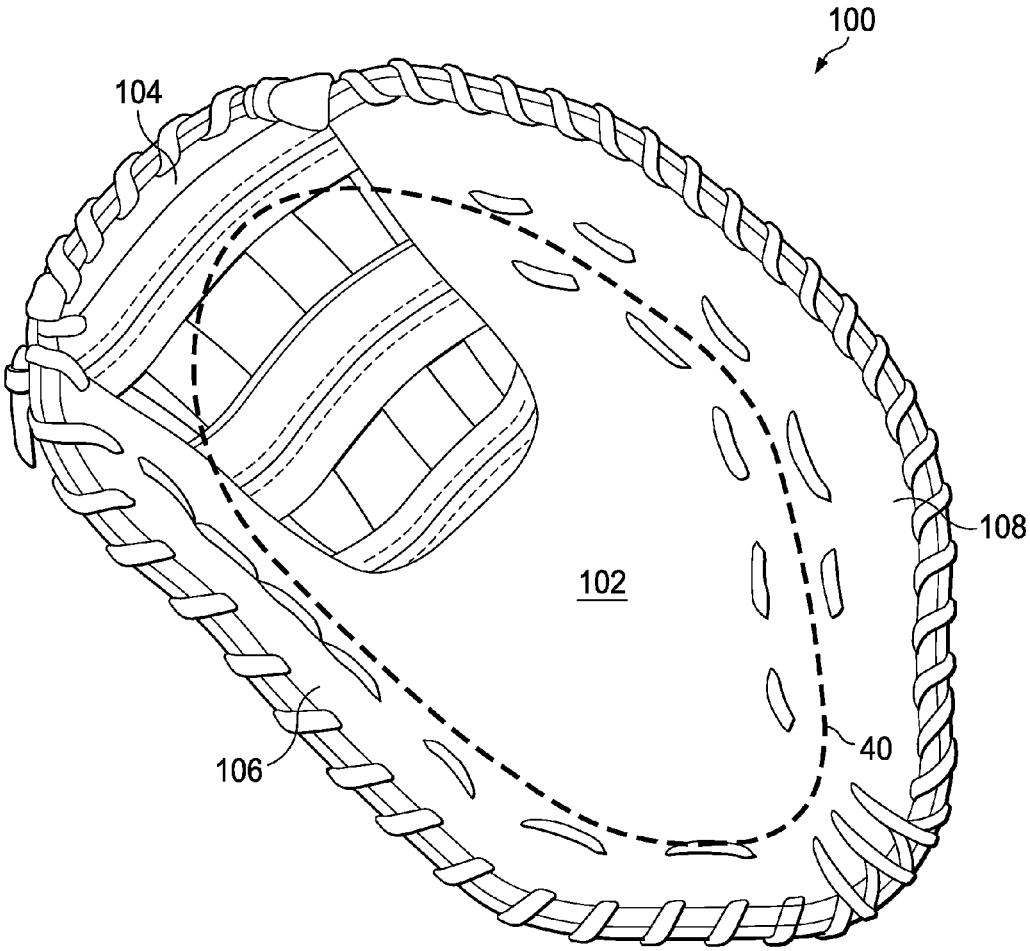
FIG. 11 is a perspective view illustrating an embodiment of the glove of FIG. 10 including a form inserted in the glove pocket.

For breaking-in a well known first baseman's glove 100, FIG. 10, the fourth form, i.e. 40, FIG. 4, can be used to form and maintain a pocket. The first baseman's glove pocket, as is well known, is the concave area 102 of the glove 100 positioned adjacent a web portion 104 and also positioned between a thumb receiving portion 106 and a multiple finger receiving portion 108. The fourth form 40 is inserted into the pocket 102, see FIG. 11.

The foregoing has described the insertion of one of the forms 10, 20, 30, 40, FIGS. 1-4, into an appropriate one of the gloves 50, 80, 100, FIG. 5, 8, or 10. The following will describe inserting a glove and a shaped form into a flexible wrap formed of a suitable fabric material.

Figure 12A:
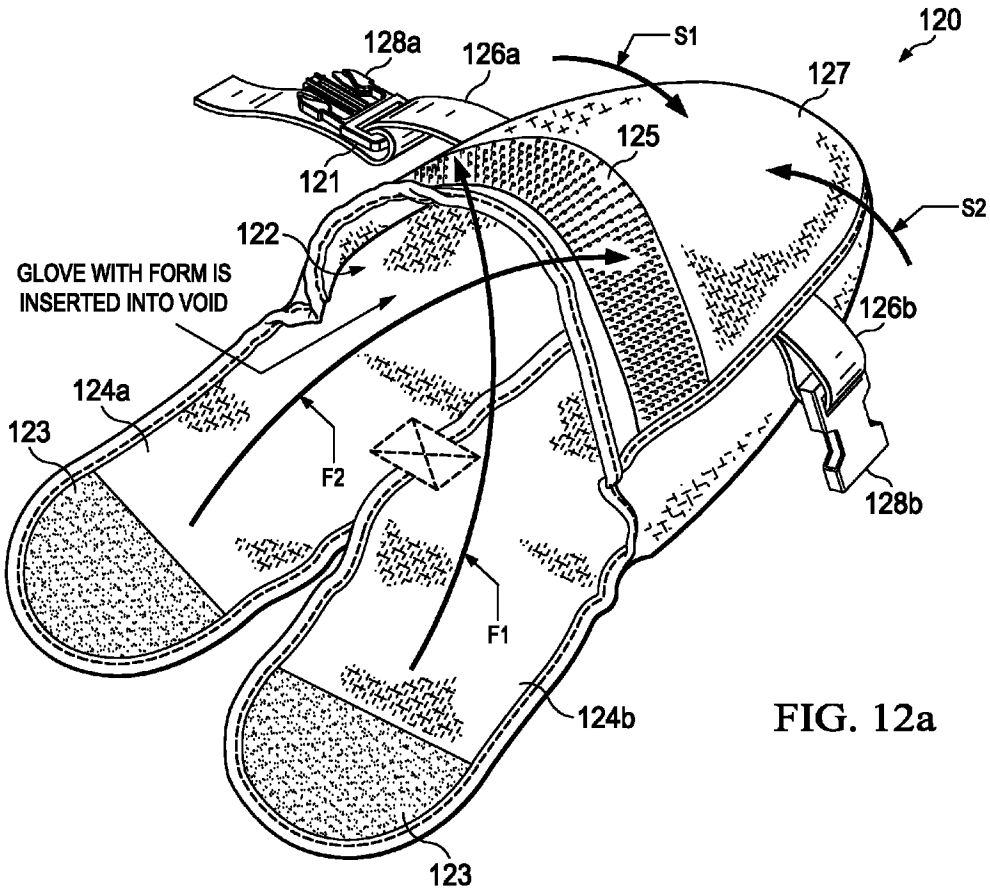
FIGS. 12*a* and 12*b* are perspective views illustrating an embodiment of first and second sides of a wrap used to secure a glove and an insert.
Figure 12B:
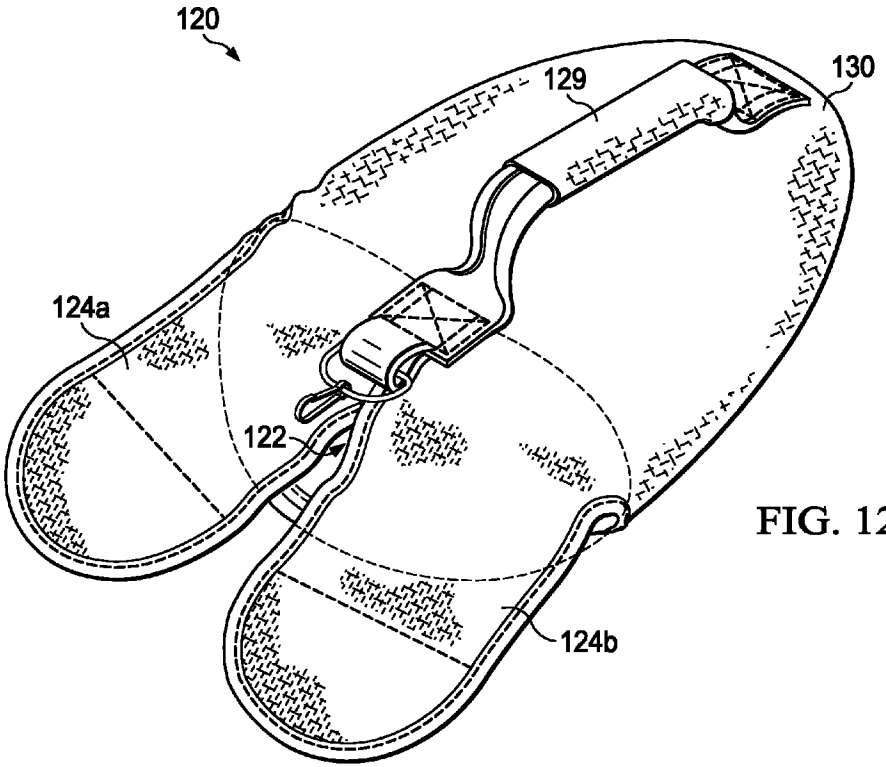

A flexible wrap 120, FIGS. 12*a* and 12*b* is provided to receive the glove 50 with the inserted form 20 and to secure and compress the glove around the form thus causing the glove pocket to be shaped around the form. The wrap also includes adjustable members, discussed below. Furthermore, the wrap can include a handle for convenient carrying and storing the glove containing the form.

Further describing a flexible wrap 120, FIGS. 12*a* and 12*b*, it can be seen that the wrap 120 includes a void 122 formed therein. A pair of flaps 124*a*, 124*b*, which may be a single flap not shown, provide a first adjustable means for securing a glove within the wrap. A pair of straps 126*a*, 126*b* provide a second adjustable means for compressing the wrap 120 around a glove and inserted form so that the glove pocket is conformed to the shape of the form being used.

For example, the fielder's glove 50, FIG. 5, and the form 20, FIG. 2, inserted into the pocket 52 of the glove, are inserted into the void 122. The flaps 124*a*, 124*b* are adjustably closed to secure the glove 50 within the wrap 120. The flaps 124*a*, 124*b* may be adjusted due to a hook 123 and loop 125 connector system as discussed below, or by another suitable adjustable connector system. Once the glove 50 is secured within the wrap 120, the straps 126*a*, 126*b* are adjustably drawn together tightly by a pair of mating snaps 128*a*, 128*b* and a slide 121 for compressing the wrap 120 around the glove 50 and the pocket inserted form 20. The hook 123 and loop 125 connector system may include a commercially available Velcro® hook and loop fastening device. The material used for the wrap 120 may be similar to material used for travel luggage or a backpack.

Returning again to FIGS. 12*a* and 12*b*, the flaps 124*a*, 124*b* are cross-folded in directions F1 and F2 as indicated by a pair of directional arrows. The hooks 123 of the flaps 124*a*, 124*b* are engaged with the loops 125 on a first side 127 of the wrap 120. This secures the glove 50 and form 20 in the void 122. Subsequently, the straps 126*a*, 126*b* are simultaneously moved in directions 51 and S2 so that the snaps 128*a*, 128*b* can be interlocked. Finally, the straps 126*a*, 126*b* are drawn tightly around the wrap 120 by advancing the strap 126*a* through the slide 121 thus urging the wrap 120 and glove 50 to be compressed about the form 20. A handle 129, FIG. 12*b* on a second side 130 of the wrap 120, opposite the first side 127 can be used to hand-carry the wrap 120 containing the glove 50 and form 20.

Figure 13:
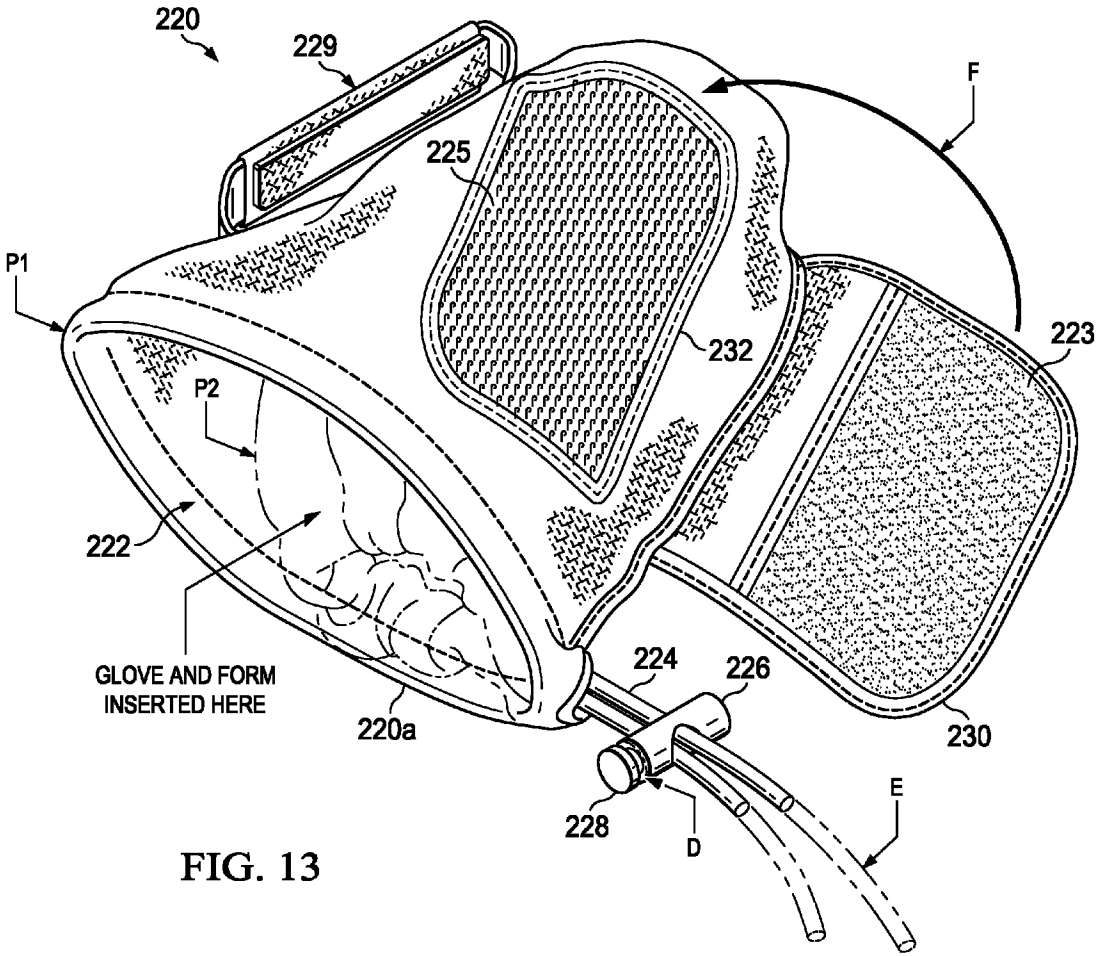
FIG. 13 is a perspective view illustrating another embodiment of a wrap used to secure a glove and an insert.

Another flexible wrap 220, FIG. 13 may also be used in a manner similar to that described above. For the purpose of forming a pocket in fielder's glove 50 using the form 10, forming a pocket in the catcher's glove 80 using the form 30, or forming a pocket in the first baseman's glove 100 using the form 40, the preferred wrap is the wrap 220 as illustrated in FIG. 13. If necessary, the size of the wrap 220 can be varied to accommodate the gloves 50, 80 and 100.

In FIG. 13, any one of the gloves 50, 80 or 100 and their respective forms 10, 30 and 40 are inserted into the wrap 220. Wrap 220 includes a void 222 formed therein. A drawstring 224 provides an adjustable means for securing a glove 50, 80 or 100 in the wrap 220. The draw string 224 is drawn through a string holding and release member 226, to reduce an end 220*a* of wrap 220 from a first position P1 to a second position P2 thus securing the glove in the wrap 220. When the draw string 224 is drawn to an extended position E, a spring loaded plunger 228 holds the string 224 and when desired, the plunger 228 is manually depressed to a position D, to release the string 224 and re-open end 220*a* to position P1.

A flap 230 is adjustable in a direction F and includes a hook and loop connective system as discussed above. The flap 230 includes a hook connector 223, which is engageable with a connector pad 232 attached to wrap 220 having a loop connector 225. The flap 230 and connector pad 232 are adjustably drawn together and engaged for compressing the wrap 220 around a glove and pocket inserted form. A handle 229 can be used to hand-carry the wrap 220.

Figure 14:
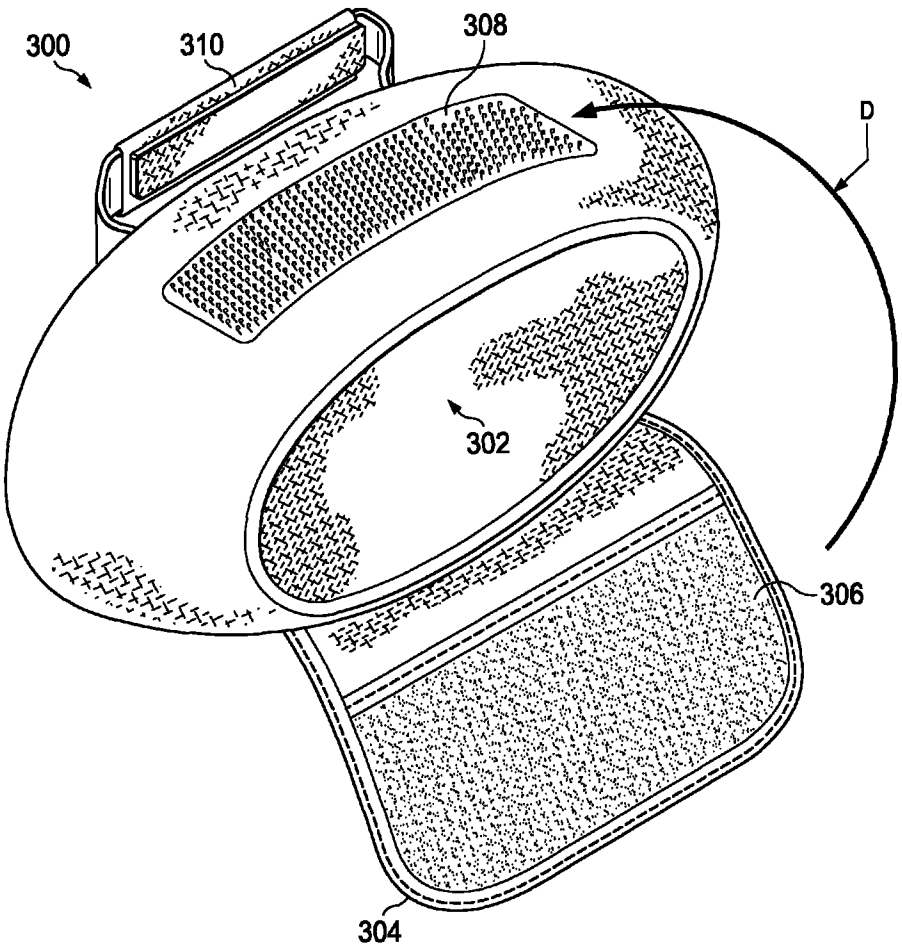
FIG. 14 is a perspective view illustrating a further embodiment of a wrap used to secure a glove and an insert.

A further flexible wrap 300, FIG. 14, may also be used in a manner similar to that described above. In FIG. 14, a glove and a respective form are inserted into a void 302 in the wrap 300. A flap 304 is adjustable in a direction D and includes a hook connector 306 and the wrap 300 includes a loop connector 308. The connector 306 of the flap 304 is adjustably drawn into engagement with the loop connector 308. This accomplishes a closing of the void 302 securing the glove and the respective form within the void 302, and also accomplishes compressing the wrap 300 around the glove and the form thus compressing the glove around the form. A handle 310 can be used to hand-carry the wrap 300.

The wraps described above can be used to protect and store a glove and an insert at any and all times and for maintaining the pocket shape when the glove is not in use. A suitable leather conditioner and lubricant material can be used to coat and penetrate the pocket of a glove to enhance the breaking-in process. Thus, it can be seen from the foregoing, that the flaps, straps and drawstrings as illustrated, can contribute in any combination and on any one of the wraps, to both secure a glove in the wrap and compress the wrap around the glove and the form inserted into the glove pocket.

Although illustrative embodiments have been shown and described, a wide range of modification, change and substitution is contemplated in the foregoing disclosure and in some instances, some features of the embodiments may be employed without a corresponding use of other features. Accordingly, it is appropriate that the appended claims be construed broadly and in a manner consistent with the scope of the embodiments disclosed herein.

What is claimed is:

1. A system comprising:

a plurality of position specific ball gloves each having a pocket;

a plurality of dedicated pocket shaping members, each pocket shaping member varying in size and shape from each other pocket shaping member, and each of the pocket shaping members being dedicated, respectively, to size and shape the pocket of a corresponding one of the position specific gloves;

wrap means for receiving a dedicated one of the shaping members mounted in the pocket of the corresponding one of the position specific gloves; and adjustable means on the wrap means for securing and compressing the wrap around the dedicated pocket shaping member and the corresponding position specific glove, whereby the pocket of the corresponding position specific glove is conformed to the size and shape of the dedicated shaping member.

2. The system as defined in claim 1, further comprising:

a handle attached to the wrap means.

3. The system as defined in claim 1 wherein the adjustable means includes at least one flap having a first connector.

4. The system as defined in claim 3 wherein the wrap means includes a second connector matingly engageable with the first connector.

5. The system as defined in claim 1 wherein the adjustable means includes at least one strap.

6. The system as defined in claim 5 wherein the adjustable means includes a snap and a slide connected to the at least one strap.

7. A method comprising:

providing a plurality of position specific ball gloves each having a pocket;

providing a plurality of pocket shaping members, each member varying in size and shape from each other member;

selecting one of the position specific ball gloves;

selecting one of the shaping members having a size and shape corresponding to a selected size and shape for the pocket of the selected ball glove;

inserting the selected shaping member in the pocket of the selected glove;

inserting the selected glove and selected shaping member in a wrap; and compressing and maintaining the wrap around the glove and shaping member, whereby the pocket of the selected glove is specifically sized and shaped corresponding to the selected shaping member.

8. The method as defined in claim 7, wherein the wrap includes a first adjustable means and a second adjustable means.

9. The method as defined in claim 8, wherein the first adjustable means includes at least one flap having a first connector.

10. The method as defined in claim 9, wherein the wrap includes a second connector matingly engageable with the first connector.

11. The method as defined in claim 8, wherein the second adjustable means includes at least one flap having a first connector.

12. The method as defined in claim 11, wherein the wrap includes a second connector matingly engageable with the first connector.

13. The method as defined in claim 8, wherein the first adjustable means includes a drawstring.

14. The method as defined in claim 13, wherein the drawstring includes a string holding and release member.

15. The method as defined in claim 7, wherein the wrap includes at least one strap.

16. The method as defined in claim 15, wherein the wrap includes a snap and a slide.

17. The method as defined in claim 7, wherein the wrap includes a flap having a first connector and the wrap having a second connector engageable with the first connector, whereby engagement of the first and second connectors secures the glove in the wrap and compresses the wrap around the glove and the shaped member.

18. The method as defined in claim 7, wherein the selected shaping member is substantially of a triangular shape having tapered linear sides.

19. The method as defined in claim 7, wherein the selected shaping member is substantially of a triangular shape having curved sides.

20. The method as defined in claim 7, wherein the selected shaping member is an elongated member having a substantially constant width and an extension at one end.

21. The method as defined in claim 7, wherein the selected shaping member is substantially bulbous having an enlarged mid-portion between opposite tapered ends.

22. The method as defined in claim 7 wherein each pocket includes a web portion, a heel portion distal from the web portion and a mid-portion between the web portion and the heel portion, and each shaping member includes a first portion seated in the web portion, a second portion seated in the heel portion and a third portion seated in the mid-portion.

23. A system for forming and maintaining a selected pocket size and shape in a position specific ball glove comprising:

at least three position specific ball gloves including a fielder's glove, a first baseman's glove and a catcher's glove;

at least three shaped means, a first one of which is provided for shaping a pocket of first size and shape in the fielder's glove, a second one of which is provided for shaping a pocket of a second size and shape in the first baseman's glove, and a third one of which is provided for shaping a pocket of a third size and shape in the catcher's glove, each of the shaped means being of a different size and shape from each other shaped means, and each of the shaped means having a size and shape for substantially engaging a web portion, a heel portion and a core portion of it's respective pocket, the core portion being between the web portion and the heel portion.

24. The system of claim 23, further comprising:

a wrap means for receiving any one of the gloves including its respective shaped means in the pocket, for maintaining the glove compressed around its respective shaped means and for protecting the glove when the glove is not in use.

* * * * *